United States Patent [19]

Oka

[11] Patent Number: 4,562,130

[45] Date of Patent: Dec. 31, 1985

[54] METHOD OF FORMING COMPOSITE IMAGES

[75] Inventor: Tateki Oka, Toyokawa, Japan

[73] Assignee: Minolta Camera Kabushiki Kaisha, Osaka, Japan

[21] Appl. No.: 532,594

[22] Filed: Sep. 15, 1983

[30] Foreign Application Priority Data

| | | | |
|---|---|---|---|
| Sep. 28, 1982 | [JP] | Japan | 57-169990 |
| Dec. 29, 1982 | [JP] | Japan | 57-228553 |
| Jan. 11, 1983 | [JP] | Japan | 58-3216 |

[51] Int. Cl.[4] ..... G03G 13/22

[52] U.S. Cl. ..... 430/54; 430/126; 430/902; 355/3 R

[58] Field of Search ..... 430/54, 120, 902; 361/229, 230; 355/3 R

[56] References Cited

U.S. PATENT DOCUMENTS

| | | | |
|---|---|---|---|
| 3,272,626 | 9/1966 | Shinn | 439/902 X |
| 3,926,824 | 12/1975 | Lipani | 430/54 X |
| 4,338,017 | 7/1982 | Nishikawa | 430/126 X |
| 4,346,982 | 8/1982 | Nakajima et al. | 430/54 X |
| 4,416,533 | 11/1983 | Tokunaga et al. | 355/3 R |

FOREIGN PATENT DOCUMENTS

| | | | |
|---|---|---|---|
| 56-87059 | 7/1981 | Japan . | |
| 57-8553 | 1/1982 | Japan . | |
| 982285 | 4/1963 | United Kingdom | 430/902 |

OTHER PUBLICATIONS

Nakajima et al., Conference IAS Annual Meeting, 1980, pp. 1123–1127.

*Primary Examiner*—John L. Goodrow

*Attorney, Agent, or Firm*—Wenderoth, Lind & Ponack

[57] ABSTRACT

The invention relates to a method of forming composite images. After a first electrostatic latent image of positive image is formed on a photosensitive member, a scorotron charger is used to correct the potential of background area to an intermediate potential. Then a second latent image is formed by exposing a negative image to the intermediate potential. This assures production of composite images of high density and good quality free from fog.

17 Claims, 34 Drawing Figures

METHOD OF FORMING COMPOSITE IMAGES

BACKGROUND OF THE INVENTION

1. Field of the Invention

The present invention relates to a method of forming satisfactory composite images free from fog.

2. Description of the Prior Art

In recent years, copying methods have been proposed of producing composite images by forming an image by exposing an original to light in the usual manner and further resorting to so-called writing with use of an OFT or laser. For example, Published Unexamined Japanese Patent Application SHO 57-8553 discloses such a method. In the first step of this method, a photoconductive member is charged by a corona charger to a surface potential Vs as seen in FIG. 1a. Subsequently in the second step, the photoconductive member thus charged is exposed to the optical image of a usual positive original as shown in FIG. 1b, with the result that the potential of the resulting image area remains approximately at the same level as Vs, while the potential of the nonimage area attenuates to VL. In the next third step, an OFT or laser is used for exposing the nonimage area to a negative image, whereupon the potential VL attenuates to VLL in corresponding relation to the image area as shown in FIG. 1c, whereby a composite latent electrostatic image is formed. The composite image is thereafter developed in the fourth step wherein the developing bias voltage is set approximately to VL. Consequently toners opposite to each other in polarity are deposited on the component latent images individually as shown in FIG. 1d.

To obtain sharp composite images free from fog by the above copying method, it is critical that the potentials Vs, VL and VLL be stable. Of these, the potential Vs is easily available with good stability at all times, for example, with use of a scorotron charger. Further the potential VLL is available also with good stability when the negative image is exposed to a sufficient amount of light. However, the intermediate potential VL between Vs and VLL is frequently unstable because the sensitivity of the photoconductive member varies from member to member and because of the temperature dependence of the sensitivity, variations in the amount of light for exposing the positive image, etc. Consequently difficulty is encountered in setting the developing bias voltage to the proper value. Meanwhile, the above publication SHO 57-8553 discloses that the potential VL is detected for controlling the amount of light for exposing the positive image, but this requires a complex device, and when the photoconductive light has irregularities in sensitivity longitudinally or circumferentially thereof, it is impossible to assure stable potentials, permitting fogging locally.

Further according to the above copying method, the latent images represented by Vs and VLL are individually developed at the same time by normal and reversal processes, which nevertheless have the drawback that fog is liable to occur and that the use of two kinds of toners for development disturbs the triboelectric characteristics thereof to result in fog. Moreover, depending on the purpose of edition, discrimination or the like, it often becomes necessary to develop the latent images with toners of different colors, but when the images are developed in two colors by a single developing device, the developing conditions, which are complicated, are liable to permit fogging, mingling of colors, etc. It is therefore best to develop the latent images by separate developing devices individually. However, experiments have shown that when developing the first latent image, i.e., the positive latent image represented by the above potential Vs, deposition of toner occurs in the form of contours along the intermediate potential (VL) edge portion of the negative latent image of VLL as shown in FIG. 2. The same is true of the case wherein the negative latent image of VLL is developed first, such that the toner is deposited in the form of contours along the intermediate potential (VL) portion of the positive latent image by an edging effect. Thus it is impossible to obtain flawless copy images.

SUMMARY OF THE INVENTION

The main object of the present invention is to provide a method of forming satisfactory composite images free from fog.

Another object of the invention is to provide a method of forming satisfactory fog-free composite images by maintaining the background area at a constant potential at all times even when the sensitivity of the photoconductive member varies from member to member or when there are variations in the sensitivity due to temperature dependence or variations in the amount of exposure.

Another object of the invention is to provide a method of forming fog-free composite images without causing any edging effect in the developing process.

Still another object of the invention is to provide a method of forming monochromatic or dichromatic composite images free from fog and with ease.

These and other objects of the invention can be fulfilled by a composite image forming method having the following features: (A) In forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

DETAILED DESCRIPTION OF THE INVENTION

First, the composite image forming method of the present invention will be described according to a first mode of practice.

Figure 3:
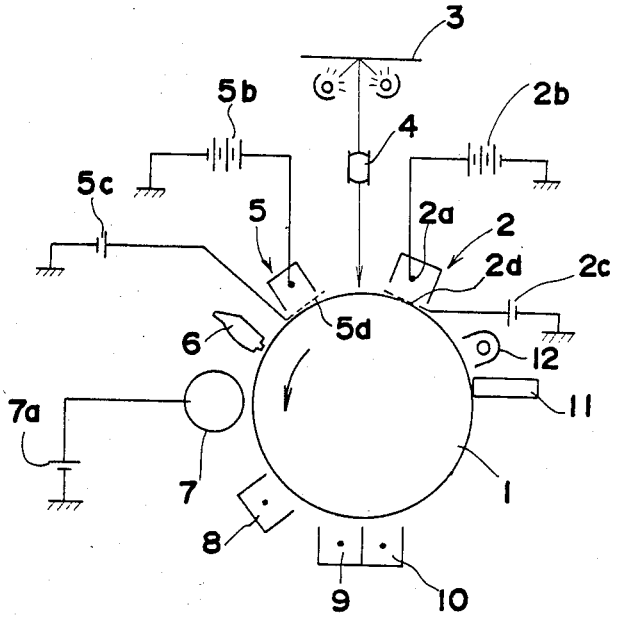
FIG. 3 is a diagram in section schematically showing the construction of a copying machine for practicing the composite image forming method of the invention in a first mode.

FIG. 3 schematically shows the construction of a copying machine for practicing the method of the invention in the first mode. A photoconductive drum 1 rotatable counterclockwise is first uniformly charged to a predetermined polarity by a first scorotron charger 2. Subsequently a positive original 3 is continuously exposed to light by an optical system 4, whereby a first latent electrostatic image is formed. The scorotron charger 2 comprises a corona electrode 2*a* connected to a d.c. high voltage source 2*b* and a grid electrode 2*d* disposed between the corona electrode 2*a* and the drum 1 and connected to a d.c. bias voltage source 2*c*. The drum 1 is charged to a potential approximately equal to the potential applied by the d.c. bias voltage source 2*c* to the grid electrode 2*d*. Instead of the scorotron charger, a usual corotron charger may be used for charging the drum to form the first latent image.

A second scorotron charger 5, which has substantially the same construction as the first scorotron charger 2, is provided next around the drum circumference from the image exposure position, and comprises a corona electrode 5*a* connected to a d.c. high voltage source 5*b* and a grid electrode 5*d* connected to a d.c. bias voltage source 5*c*. The d.c. bias voltage source 5*c* may be replaced by a constant-voltage diode, discharge tube, ZnR or like constant-voltage driven element. As will be described later, the second scorotron charger 5 functions to make the potential of the background area of the first latent electrostatic image approximately equal to the potential applied by the d.c. bias voltage source 5*c* to the grid electrode 5*d*.

Indicated at 6 is a laser scanner, OFT, light-emitting diode array, liquid crystal array or like negative latent image forming means for producing a second latent electrostatic image. A magnetic brush developing roller 7 for developing the first and second latent images is adapted to have a predetermined bias voltage Vb applied thereto by a d.c. voltage source 7*a*. As will be described later, toners opposite to each other in polarity are deposited on the first and second latent images individually by the roller 7 for development. Indicated at 8 is a precharging corona charger for charging the toners of different polarities to the same polarity, at 9 a transfer corona charger for transferring the developed image to copy paper, at 10 a separating corona charger for separating the image bearing paper from the drum surface, at 11 a blade cleaner for removing the remaining developer and at 12 an eraser lamp for removing the residual charges.

The composite image forming method of the first mode according to the invention is practiced in the following manner with use of the above copying machine.

In the first step, the photoconductive drum 1 is charged, for example, to positive polarity by the first scorotron charger 2. The drum is charged to an initial surface potential V1 approximately equal to the voltage applied to the grid electrode 2*d* by the d.c. bias voltage source 2*c* (see FIG. 4*a*). As already stated, a usual corotron charger may be used in place of the scorotron charger for the charging of the first step.

Figure 4A:
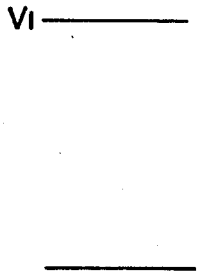
FIGS. 4*a* to 4*e* are diagrams showing the first mode of the composite image forming method stepwise as practiced by the copying machine of FIG. 3.
Figure 4B:
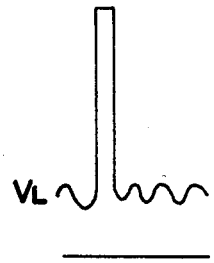

The drum 1 charged to the initial surface potential V1 is exposed to the optical image of the positive original 3 in the second step, in which the potential of the image area almost remains V1 but the potential of the nonimage area (background area) attenuates to VL as shown in FIG. 4*b*. The potential VL is not always constant but is unstable because the sensitivity of the drum varies from drum to drum and further because of the variation of sensitivity due to temperature dependence and the variation in the amount of light for exposing the positive original 3. The unstability of the potential VL presents extreme difficulty in setting the developing bias voltage of the fifth step to be described later to a level nearly equal to or slightly higher than this potential to inevitably result in fog.

Figure 4C:
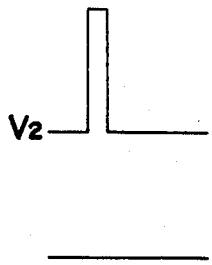

In view of the above problem, the unstable potential V1 is set to a stable intermediate level V2 which is constant at all times, in the subsequent third step according to the invention. To realize this by charging with the second scorotron charger 5, the voltage Vg to be applied to the grid electrode 5*d* by the d.c. bias voltage source 5*c* is set to a value higher than VL but sufficiently lower than the initial surface potential V1. Thus the unstable potential VL is corrected to the stable constant intermediate potential V2 which is approximately equal to Vg as shown in FIG. 4*c* by charging the nonimage area with the charger 5 to the same polarity as the charging of the first step.

Figure 5:
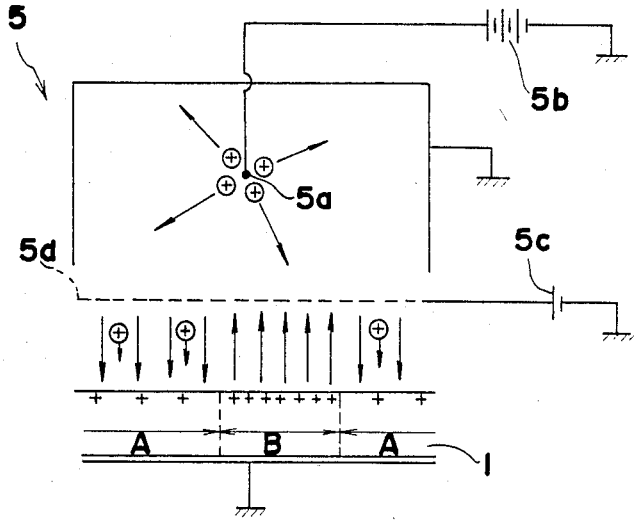
FIG. 5 is a diagram showing the principle of operation of the scorotron charging means to be used in the invention.

The third step will be described in greater detail with reference to FIG. 5 showing the principle of charging by the second scorotron charger 5. After the completion of the second step, the unstable potential VL is present in regions A on the drum 1, and a potential corresponding to V1 is present in a region B thereon. Now suppose the background area potential in the regions A, although varying, is about 150 volts, the image area potential in the region B is 600 volts, and the VL is to be corrected to the intermediate potential V2, e.g. 300 volts. In this case, the voltage Vg to be applied to the grid electrode 5*d* by the d.c. bias voltage source 5*c* is set to 300 volts equal to the desired intermediate potential V2. In this state, a high voltage is applied to the corona electrode 5*a* by the d.c. high voltage source 5*b* to initiate corona discharge, with the d.c. voltage Vg of 300 volts applied to the grid electrode 5*d*. Consequently, an electric field acting to move corona ions toward the drum 1 is set up between the grid electrode 5*d* and the regions A on the drum 1 since the latter are lower in potential, while an electric field reversely acting toward the grid electrode is produced between the region B and the grid electrode since the grid electrode is lower in potential. Accordingly the regions A having the potential VL are uniformly charged to the intermediate potential V2 of 300 volts approximately equal to the voltage Vg applied to the grid electrode 5*d* but will not be charged to a higher level. In contrast, the region B, which remains unaffected by the discharge action of the corona electrode, retains the potential V1 corresponding to the image area. In the third step, therefore, the pattern of the first latent electrostatic image remains intact, while the potential VL of the nonimage area is corrected to the stable intermediate potential V2. Although the voltage Vg applied to the grid electrode 5*d* has been described as being approximately equal to the intermediate potential V2, Vg need not always be equal to V2 but can be higher than V2 insofar as the nonimage area can be charged to the desired level V2, because the relation Vg and V2 is dependent on various conditions such as the speed of rotation of the drum 1.

Figure 4D:
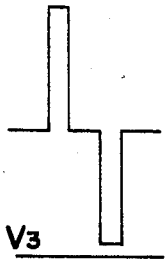

In the fourth step, the portion of the drum 1 charged to the intermediate potential V2 is exposed to a negative image to form the second latent electrostatic image, using a laser scanner, OFT, light-emitting diode array or like means 6 as already stated. The exposure to the negative image attenuates the intermediate potential V2 to V3 in corresponding relation to the negative image area, forming the second latent image as seen in FIG. 4*d*. In this way, a composite latent electrostatic image composed of the three different potentials V1, V2 and V3 is formed on the drum 1 by the first to fourth steps.

Figure 4E:
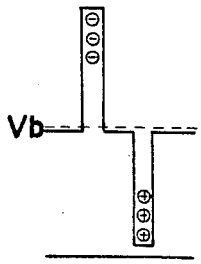

The composite latent image is developed by the developing roller 7 with the application of predetermined developing bias voltage Vb by the d.c. voltage source 7*a* in the next fifth step. With the developing bias voltage Vb set to a level approximately equal to or slightly higher than the intermediate potential V2 as seen in FIG. 4*e*, two kinds of toners which are different from each other in polarity are used as a developer. The toner of negative polarity is deposited by normal development on the positive latent image area represented by the potential V1, and the toner of positive polarity is deposited by reversal development on the negative latent image area represented by the potential V3. The toners may be of the same colors, while if they are colored, for example, black and red, the first and second latent images will be developed in a different colors and this facilitates discrimination.

For example, the magnetic brush process is usable for the development. A developer may be used which comprises a particulate iron carrier and two kinds of toners charged to different polarities for a single developing process with application of the developing bias voltage Vb. Alternatively two developing units may be used which are arranged side by side for performing normal development and reversal development as divided processes. Further for conducting normal development and reversal development in a single process, it is possible to use the two-component developer disclosed in U.S. Pat. No. 4,284,702 assigned to the present assignee. This developer comprises at least two components, i.e., a nonmagnetic insulating toner and a high-resistivity magnetic carrier triboelectrically chargeable with the toner and having a high resistivity of at least $10^{12}$ ohm-cm. The carrier is about 5 to about 40 microns in particle size, is prepared by dispersing a magnetic fine powder in an insulating resin and contains the magnetic fine powder in a proportion of 50 to 75% by weight. The developer is much superior to conventional ones especially in resolving power and latitude. State more specifically, the developer is used, for example, in the magnetic brush developing apparatus disclosed in U.S. Pat. No. 4,338,880, wherein the high-resistivity magnetic carrier and the nonmagnetic insulating toner are agitated and thereby triboelectrically charged to polarities opposite to each other for the magnetic brush developing process. With the application of developing bias voltage Vb which is nearly equal to or slightly higher than the intermediate potential V2 and with a range of threshold voltage values, the toner is deposited on the image area of the first latent image, and the carrier on the image area of the second latent image. The developer also assures easy discrimintation if the carrier and the toner have different colors.

After the composite latent electrostatic image on the drum 1 has been developed in this way, the drum 1 is charged to negative polarity opposite to that of the first step by the precharging corona charger 8, whereby the two kinds of toners or the toner and the carrier of different polarities are made to have the same polarity. However, when pressure or heat is used for transfer, the precharging corona charger can be dispensed with. Subsequently positive corona ions are applied to the rear side of copy paper by the transfer corona charger 9 to transfer the developed image onto the paper. The copy paper is then separated from the drum by the separating corona charger 10 and fed to an unillustrated fixing unit, by which the image is fixed to give a finished copy. On the other hand, the developer remaining on the drum 1 is removed by the blade cleaner 11, and the residual charges are eliminated by the eraser lamp 12 to render the drum 1 ready for the next copying cycle.

Figure 6:
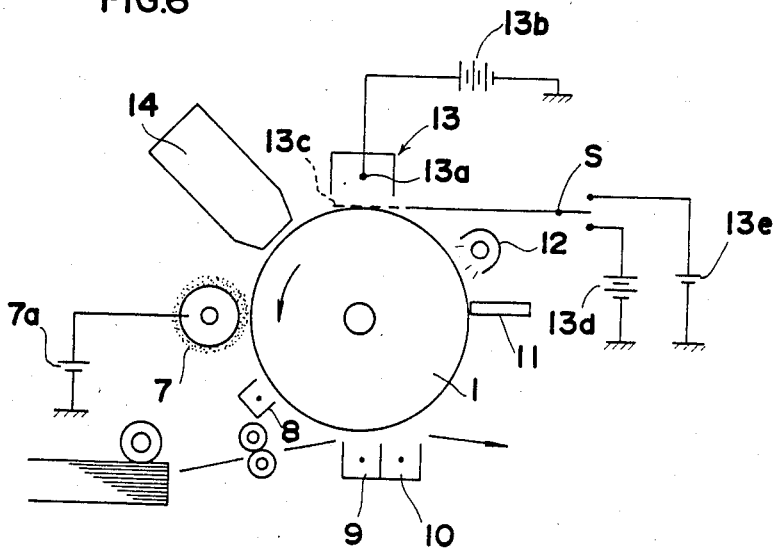
FIG. 6 is a diagram in section schematically showing the construction of a copying machine which is a modification of the embodiment of FIG. 3 and which is adapted to practice the composite image forming method in the first mode.

FIG. 6 shows another embodiment of copying machine for practicing the composite image forming method of the invention in the first mode. Unlike the apparatus of FIG. 3, this embodiment is characterized in that single means is used for uniformly charging a photoconductive drum 1 prior to the formation of first and second latent electrostatic images, as well as for forming a positive latent image and a negative latent image and that the drum 2 is rotated two turns for forming a composite image. The copying machine shown in FIG. 3 requires two chargers, i.e., the first and second scorotron chargers 2 and 5, for charging to the initial surface potential V1 and to the intermediate potential V2 and also two optical systems, i.e., the system 4 and the means 6 such as OFT or laser, which invariably make the machine very large-sized, complex and considerably expensive. However, the construction of FIG. 6, which need only to have one such charging means and one latent image forming means, can be small-sized and inexpensive.

To describe the machine of FIG. 6 in greater detail, indicated at 13 is a scorotron charger comprising a corona electrode 13*a* connected to a d.c. high voltage source 13*b*, and a grid electrode 13*c* connectable by a switch S to a first d.c. voltage source 13*d* for applying a bias voltage Vg1 and to a second d.c. voltage source 13*e* for applying a bias voltage Vg2. Indicated at 14 is positive and negative latent electrostatic image forming means comprising, for example, an OFT, laser scanner, liquid crystal shutter or LED and adapted to expose the drum 1 to a positive image during the first turn of its rotation and to a negative image during the second turn of rotation. The drum 1 has a circumferential length slightly larger than the maximum length of images. With the exception of these features, the machine of FIG. 6 has the same construction as the one shown in FIG. 3, so that like parts are referred to by like numerals in lieu of description.

With the copying machine of the above construction, the drum 1 rotating in the illustrated direction is uniformly charged to a surface potential V1 first by the scorotron charger 13, with the switch S closed for connection to the first d.c. voltage source 13*d* to apply the voltage Vg1 to the grid electrode 13*c*. Thus the drum is charged to the potential V1 as in the foregoing first step and as shown in FIG. 4*a*. Subsequently in the second step, the drum 1 is exposed to a positive image by the latent image forming means 14 to form a first latent electrostatic image as shown in FIG. 4*b*. As already stated, the resulting nonimage area has an unstable potential VL.

When the drum 1 is brought into the second turn of rotation after rotating exactly one turn, the scorotron charger 13 operates again, with the switch S closed for connection to the second d.c. voltage source 13*e* to apply the voltage of Vg2 to the grid electrode 13*c*, whereby the potential VL of the nonimage area is corrected to the intermediate potential V2, with the image area potential V1 remaining unaffected as described with reference to FIG. 5 (see FIG. 4*c*). Next, the drum 1 has its portion of the intermediate potential V2 exposed to a negative image by the latent image forming means 14, whereby a second latent electrostatic image is formed to produce a composite latent image as shown in FIG. 4*d*. The composite latent image thus formed is then developed by the developing roller 7 with the application of bias voltage Vb (see FIG. 4*e*). The same developing process and developer as those already stated are usable. The developed image is charged by the precharging corona charger 8 and then transferred onto copy paper by the transfer corona charger 9. The paper is separated from the drum 1 and fed to an unillustrated fixing unit for fixing. On the other hand, the remaining developer is removed from the drum 1 by the blade cleaner 11, and the eraser lamp 12 eliminates the residual charges to make the drum 1 ready for the next copying cycle.

Next, the second mode of the composite image forming method according to the invention will be described.

Figure 7:
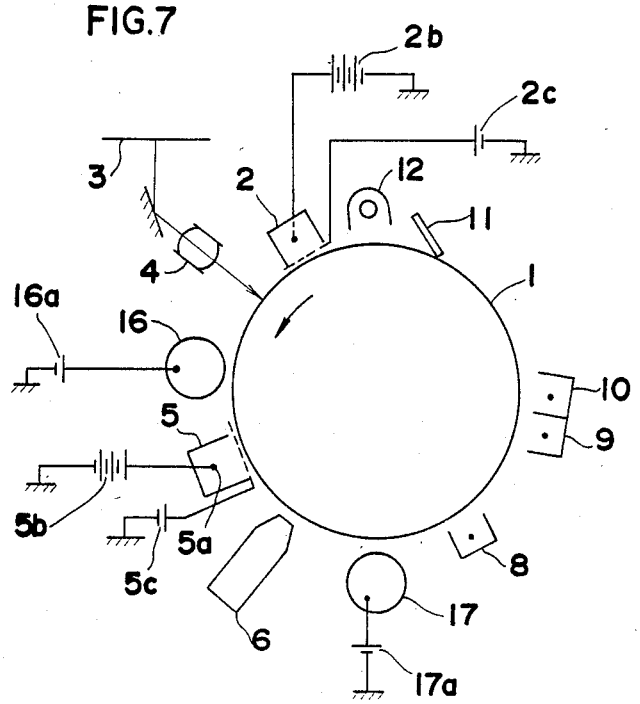
FIG. 7 is a diagram in section showing a copying machine for practicing the composite image forming method of the invention in a second mode.

FIG. 7 shows a copying machine for practicing the second mode of the method. The same parts as those shown in FIG. 3 will be referred to by the same corresponding numerals individually and will not be fully described. With reference to FIG. 7, a positive original 3 is exposed to light by an optical system 4 to form a first latent electrostatic image, which is then developed by a first magnetic brush developing roller 16. The roller 16 is adapted to have a predetermined bias voltage Vb1 applied thereto by a d.c. bias voltage source 16*a* to deposit a toner on the first latent image of a potential of at least Vb1 by normal development.

Indicated at 5 is the same second scorotron charger as already stated. The charger 5 is adjacent to the first developing roller 16 and positioned toward the direction of rotation of the drum 1 from the roller 16. Negative latent image forming means 6 is adapted to form a second latent image electrostatic image immediately after charging by the second scorotron charger 5. Thus the second latent image is formed after the first latent image has been developed. A second magnetic brush developer roller 17 for developing the second latent image is adapted to have a predetermined bias voltage Vb2 applied thereto by a d.c. bias voltage source 17*a*, whereby a toner opposite in polarity to the toner for developing the first latent image is deposited on the second latent image by reversal development.

With use of the copying machine of FIG. 7, the second mode of the composite image forming method is practiced in the manner shown in FIGS. 8*a* to 8*f*.

Figure 8A:
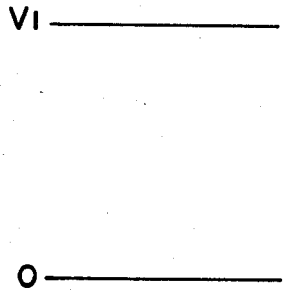
FIGS. 8*a* to 8*f* are diagrams showing the second mode of the composite image forming method stepwise as practiced by the copying machine of FIG. 7.
Figure 8B:
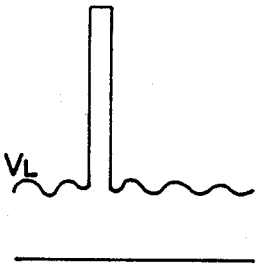

The first and second steps shown in FIGS. 8*a* and 8*b* are the same as those shown in FIGS. 4*a* and 4*b*. The potential VL resulting from the second step is unstable and makes it difficult to set the developing bias voltage for the development of the sixth step.

Figures 1A, 1B, 1C, 1D:
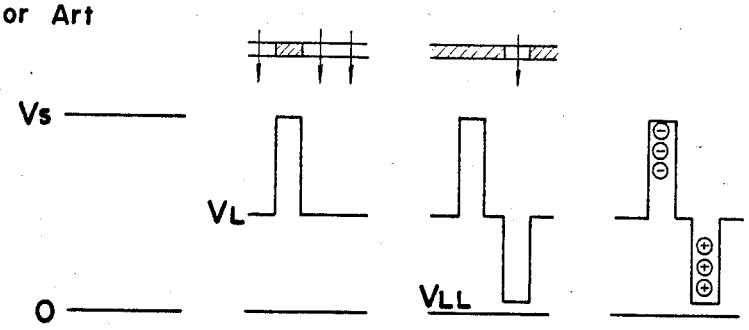
FIG.1a FIG.1b FIG.1c FIG.1d Prior Art
FIGS. 1*a* to 1*d* are diagrams showing a conventional composite image forming method stepwise.
Figure 2:
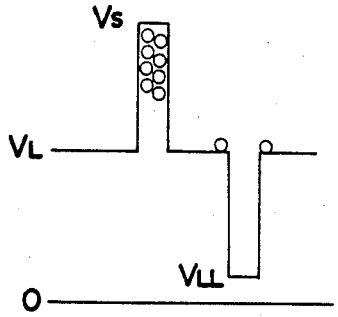
FIG.2 Prior Art
FIG. 2 is a diagram showing the deposition of toner due to an edging effect produced when a composite latent image is developed by two separate processes according to the prior art.
Figure 8C:
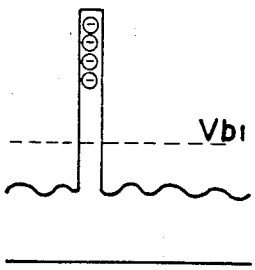

In the third step, the first latent electrostatic image is developed (see FIG. 8*c*). Using the first magnetic brush developing roller 16, a toner of negative polarity is deposited on the potential portion of at least Vb1 by normal development with application of the bias voltage Vb1 which is set to a higher level than the nonimage area potential VL and applied by the d.c. bias voltage source 16*a*. Since no second latent image is present at this time, no noise is likely to result from the edging effect shown in FIG. 2. Further because the nonimage area potential VL is unstable and involves variations as already described, the bias voltage Vb1 is set to a level sufficiently higher than VL. In connection with this, the exposure of the second step is made with a sufficient amount of light, whereby it is made possible to give a sufficient potential difference between Vb1 and V1 to assure high-density development even if VB1 is set to a level well above the range of variations of VL.

Figure 8D:
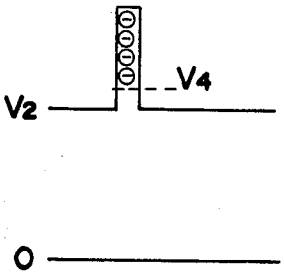

The fourth step is adapted to correct the nonimage area potential VL to a level which is stable and constant at all times and give a sufficient potential difference to the second latent electrostatic image to be formed in the fifth step to be described later. More specifically, the unstable potential VL is corrected to an intermediate potential V2 which is constant and stable at all times by charging with the scorotron charger 5. At this time, the voltage Vg to be applied to the grid electrode 5*d* by the d.c. bias voltage source 5*c* is set to a value higher than the above-mentioned VL but lower than the potential V4 reduced by the deposition of the negative toner on the initial surface potential (V1) portion in the third step. Consequently, as seen in FIG. 8*d*, the unstable potential VL is corrected to the stable constant intermediate potential V2 approximately equal to Vg. The charge given in this step has the same polarity as that of the first step.

The principle of charging by the second scorotron charger 5 in the fourth step is substantially the same as shown in FIG. 5; the charging is so done that the intermediate potential V2 will be between V4 and VL. At this time the first latent image as developed with the toner remains in no way affected.

Figure 8E:
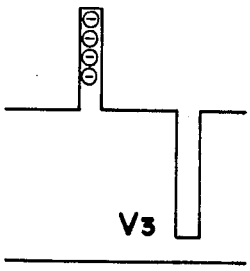

In the fifth step, the portion of the drum 1 charged to the intermediate potential V2 is exposed to a negative image by the negative latent image forming means 6 to form a second latent electrostatic image. As seen in FIG. 8*e*, the intermediate potential V2 corresponding to the negative image area is attenuated to V3.

Figure 8F:
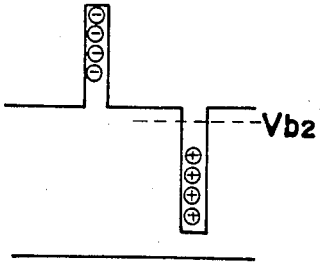

In the sixth step, the second latent image is developed by the second magnetic brush developing roller 17 with the application of the predetermined developing bias voltage Vb2 by the d.c. bias voltage source 17*a*. As shown in FIG. 8*f*, the bias voltage Vb2 is set to a level slightly lower than the intermediate potential V2 to effect reversal development, whereby a toner of positive polarity is deposited on the second latent image having the potential V3. Ordinarily, the toner of positive polarity is likely to be deposited on the boundary of the developed first latent image adjoining the intermediate potential (V2) area owing to an edging effect, but such deposition of the toner does not occur since the potential of the first latent image has been substantially lowered to V4 by the deposition of the toner of negative polarity. Meanwhile, if the toner used for the present step is different in color from the toner for the third step, the first and second latent images are developed in different colors and therefore can be discriminated easily. The developer can be one comprising two components, e.g. an iron particulate carrier and a toner. Further the developer disclosed in the aforementioned U.S. Pat. No. 4,284,702 may be used (with the toner and the carrier in opposite relation to each other in polarity). The composite latent electrostatic image thus developed is thereafter made into a finished copy by the same procedure as is the case with the copying machine of FIG. 3, i.e., by charging with the precharging corona charger 8, transfer to copy paper by the transfer corona charger 9, separation by the separating corona charger 10 and fixing. On the other hand, the drum 1 is acted on by the blade cleaner 11 and eraser lamp 12 in preparation for the next copying cycle.

Figure 9:
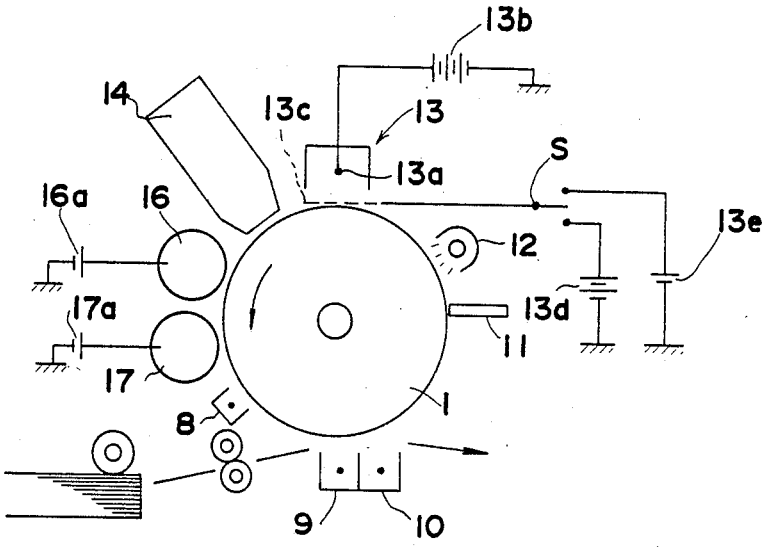
FIG. 9 is a diagram in section showing the construction of a copying machine which is a modification of the embodiment of FIG. 7 and which is adapted to practice the composite image forming method in the second mode.

FIG. 9 shows a copying machine which is a modification of the machine of FIG. 7 and in which the photoconductive drum 1 is rotated two turns for forming a composite image. Basically the machine differs from the copying machine of FIG. 6 only in that the first and second magnetic brush developing rollers 16 and 17 described with reference to FIG. 7 are arranged side by side between the latent image forming means 14 and the precharging corona charger 9. Accordingly, like parts in FIG. 9 are referred to by like reference numerals in FIGS. 6 and 7. The copying machine of FIG. 9 operates in the following manner.

First, the drum 1 is charged to a potential V1 by the scorotron charger 13 and then exposed to a positive image by the latent image forming means 14 to form a first latent electrostatic image as shown in FIG. 8*b*.

Next, the first latent image is developed as shown in FIG. 8*c* by the first developing roller 16 with the application of bias voltage Vb1 by the d.c. bias voltage source 16*a*. The second developing roller 17 is held out of operation during the first turn of rotation of the drum 1.

When the drum 1 is brought into the second turn of rotation after rotating exactly one turn, the scorotron charger 13 operates again, with the switch S closed for connection to the second d.c. voltage source 13*e* to apply a voltage of Vg2 to the grid electrode 13*c*, whereby the potential VL of the nonimage area is corrected to an intermediate potential V2, with the image area potential V1 remaining unaffected as described with reference to FIG. 5 (see FIG. 8*d*). Next, the drum 1 has its portion of the intermediate potential V2 exposed to a negative image by the latent image forming means 14, whereby a second latent electrostatic image is formed as shown in FIG. 8*e*.

The second latent image is subsequently subjected to reversal development as shown in FIG. 8*f* by the second magnetic brush developing roller 17 with the application of bias voltage Vb2 from the d.c. bias voltage source 17*a*. The developed composite image is thereafter transferred onto copy paper, while the residual toner and charges are removed from the drum 1.

Figure 10:
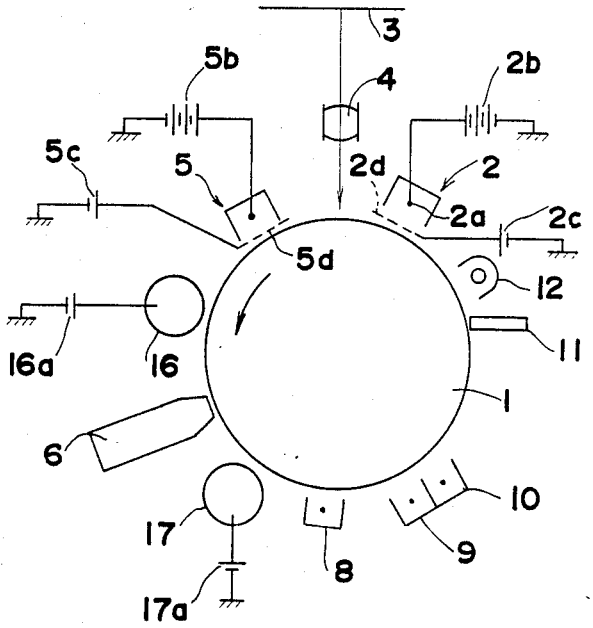
FIG. 10 is a diagram in section showing a copying machine for practicing the composite image forming method of the invention in a third mode.

Next, a third mode of the composite image forming method will be described with reference to FIG. 10 showing a copying machine, which has the same construction as the machine of FIG. 7 except that some elements are arranged in a different order, so that throughout these drawings, the parts are referred to by like reference numerals. More specifically with reference to FIG. 10, arranged around a photoconductive drum 1 in the direction of rotation thereof are a first scorotron charger 2, exposure assembly for a positive original 3, second scorotron charger 5, first magnetic brush developing roller 16, negative latent image forming means 6, second magnetic brush developing roller 17, precharging corona charger 8, transfer corona charger 9, separating corona charger 10, blade cleaner 11 and eraser lamp 12. A composite image is formed by the copying machine through the steps shown in FIGS. 11*a* to 11*f*.

Figure 11A:
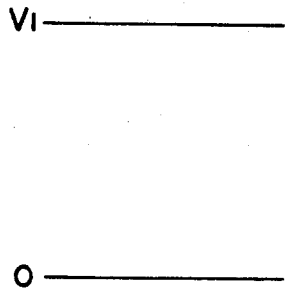
FIGS. 11*a* to 11*f* are diagrams showing the third mode of the composite image forming method stepwise as practiced by the copying machine of FIG. 10.
Figure 11B:
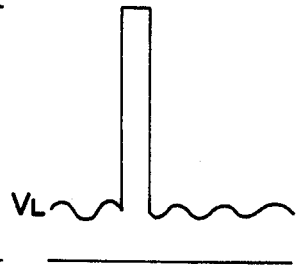
Figure 11C:
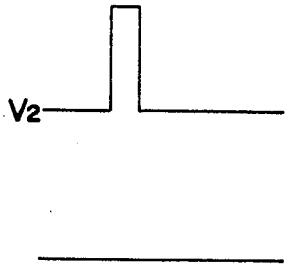
Figure 11D:
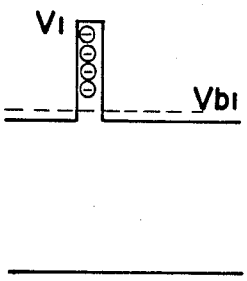

The first to third steps shown in FIGS. 11*a* to 11*c* are the same as those shown in FIGS. 4*a* to 4*c*, whereas unlike the steps shown in FIGS. 8*a* to 8*c* wherein the first latent electrostatic image formed is subsequently developed, the background area of the first latent image is charged by the second scorotron charger 5 for correction according to the third mode. In the fourth step, the first latent image is developed by the first magnetic brush developing roller 16 with application of a bias voltage Vb1 set to a level slightly higher than the aforementioned intermediate potential V2 and applied by the d.c. voltage source 16*a*. Thus a toner of negative polarity is deposited on the potential area of Vb1 to V1 by normal development as shown in FIG. 11*d*. Since there is no negative second latent image present at this time, the developed image is free from smudge owing to the edging effect shown in FIG. 2.

Figure 11E:
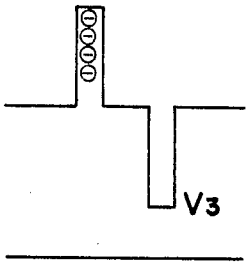

In the subsequent fifth step, the drum 1 is exposed to a negative image by the negative latent image forming means 6 over the area thereof other than the first image area formed by the fourth step and charged to the intermediate potential V2 to form a second latent electrostatic image (see FIG. 11*e*). The second latent image is developed by the second developing roller 17 in the sixth step (see FIG. 11*f*), which is the same as the step shown in FIG. 8*f* and therefore will not be described.

Figure 11F:
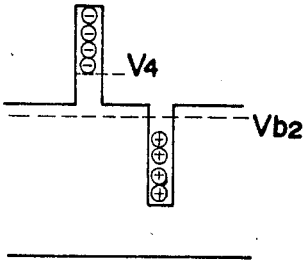
Figure 12:
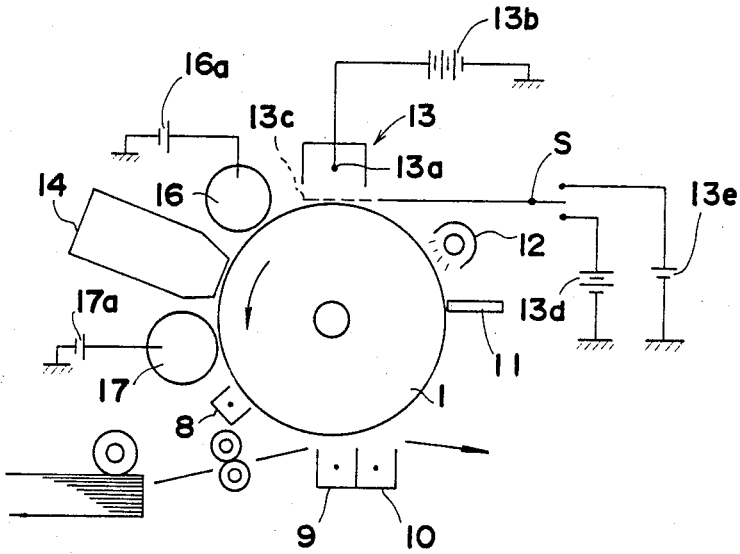
FIG. 12 is a diagram in section showing the construction of a copying machine which is a modification of the embodiment of FIG. 10 and which is adapted to practice the composite image forming method in the third mode.

FIG. 12 shows another embodiment of copying machine for practicing the third mode of the composite image forming method. This embodiment has the same construction as the machine of FIG. 9 except that a first magnetic brush developing roller 16, latent electrostatic image forming means 14 and second magnetic brush developing roller 17 are arranged in this order subsequent to a scorotron charger 13. During the first turn of rotation, the drum 1 is charged to a potential V1 by the scorotron charger 13 (with the switch S closed for connection to the first d.c. voltage source 13*d*) and then exposed to a positive image by the image forming means 14 to form a first latent electrostatic image. During the first turn of rotation of the drum 1, both the first and second developing rollers 16 and 17 are held out of operation. When initiated into the second turn of rotation, the drum is charged again by the scorotron charger 13, with the switch S closed for connection to the second d.c. voltage source 13*e*, to correct the potential V1 to V2 (FIG. 11*c*). Next, the first latent image is developed by the first developing roller 16 with the application of bias voltage Vb1 from the bias voltage source 16*a* (FIG. 11*d*). Subsequently the area of potential V2 is exposed to a negative image by the latent image forming means 14 to form a second latent electrostatic image (FIG. 11*e*). The latent image is developed by the second developing roller 17 with the application of bias voltage Vb2 (FIG. 11*f*). The machine thereafter operates in the same manner as the machine of FIG. 9.

Figure 13:
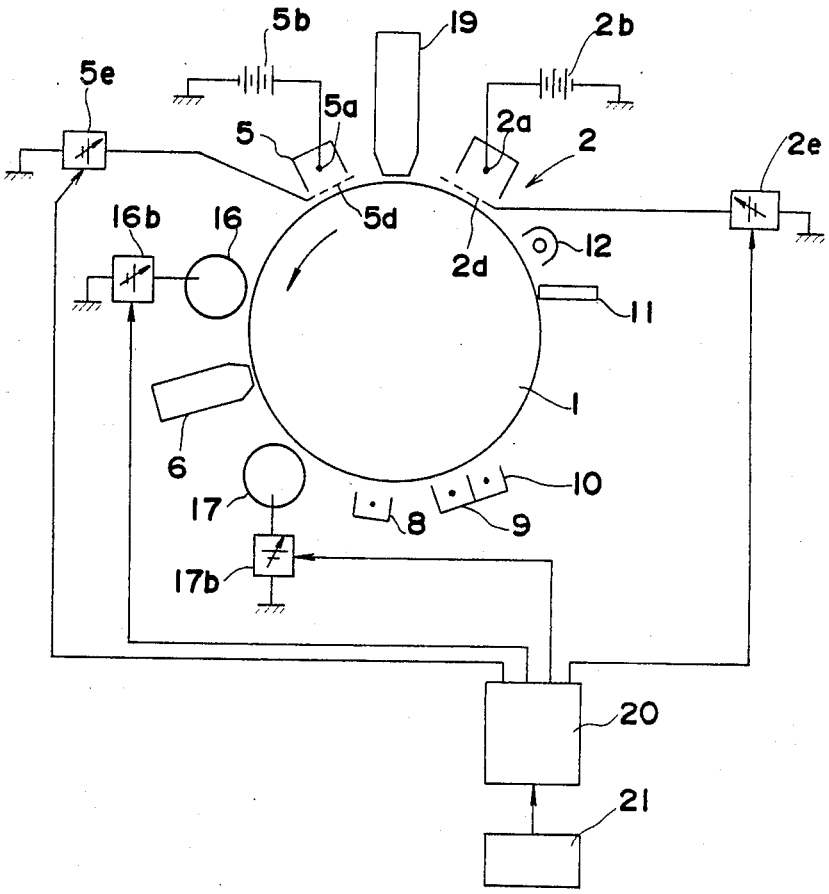
FIG. 13 is a diagram showing a copying machine which is another modification of the embodiment of FIG. 10 and which is adapted to practice the composite image forming method in the third mode.

FIG. 13 shows another embodiment of copying machine for practicing the composite image forming method of the invention in the third mode. Throughout FIGS. 10 and 13, like parts are referred to by like numerals and will not be described. With reference to FIG. 13, a first scorotron charger 2 includes a grid electrode 2*d* connected to a variable d.c. bias voltage source 2*e*, while a second scorotron charger 5 includes a grid electrode 5*d* connected to a similar variable d.c. bias voltage source 5*e*. Each of the voltages to be applied is variable in accordance with an instruction from a controller 20. Indicated at 16*b* and 17*b* are variable d.c. voltage sources connected to first and second magnetic brush developing rollers 16 and 17 for applying a variable voltage under the control of the controller 20. Indicated at 19 is positive latent electrostatic image forming means, such as a laser scanner. Indicated at 21 is means connected to the controller 20 for selecting the desired mode from among the plurality of copy modes to be given below, whereby the voltages to be applied by the voltage sources 2*e*, 5*e*, 16*b* and 17*b* are controlled through the controller.

The first and second latent electrostatic images are developed in two colors, each with different densities, to provide the four copy modes listed in Table 1 below.

TABLE 1

| | | |
|---|---|---|
| Mode I | Dark black | Dark red |
| Mode II | Light black | Dark red |
| Mode III | Dark black | Light red |
| Mode IV | Light black | Light red |

The red toner is deposited by the first magnetic brush developing roller 16, and the black toner by the second magnetic brush developing roller 17. With use of each toner, copy images of low density are obtained when the difference between the image potential on the drum 1 and the developing bias voltage is, for example, 100 V, while copy images of high density are available when the difference is sufficiently larger than 100 V, for example, 200 V. The developing bias voltage is 50 V higher than the intermediate potential V2 when developing the first latent image and 50 V lower when developing the second latent image. Table 2 shows the voltages to be applied by the variable d.c. bias voltage sources 2*e*, 5*e*, 16*b* and 17*b* for the respective copy modes and fulfilling these conditions.

TABLE 2

| Mode | Voltage source 2e | 5e | 16b | 17b |
|---|---|---|---|---|
| Copy mode I | 550 V | 300 V | 350 V | 250 V |
| Copy mode II | 450 V | 200 V | 250 V | 150 V |
| Copy mode III | 450 V | 300 V | 350 V | 250 V |
| Copy mode IV | 350 V | 200 V | 250 V | 150 V |

In Table 2, it is assumed that the photoconductive drum is charged to a potential equal to the voltage applied by the d.c. bias voltage source 2*e* or 5*e* and that the image area potential V3 of the negative second latent image is 50 V. Further as will be apparent from the description of FIG. 11, the voltages applied by 2*e*, 5*e*, 16*b* and 17*b* in Table 2 correspond to V1, V2, Vb1 and Vb2, respectively.

Figure 14A:
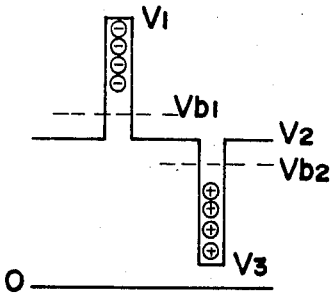
FIGS. 14*a* to 14*d* are diagrams showing various developing potential patterns produced when the copying machine of FIG. 13 is used.
Figure 14B:
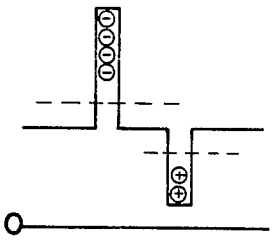
Figure 14C:
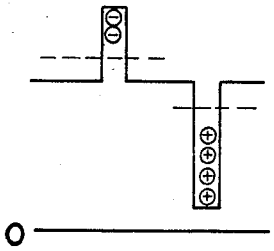
Figure 14D:
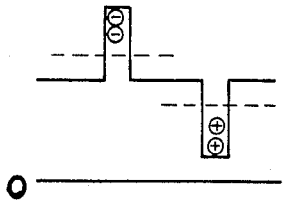

FIGS. 14*a* to 14*d* show the developing potential patterns of the copy modes I to IV. In the copy mode I shown in FIG. 14*a*, V1 is 550 V, V2 is 300 V and V3 is 50 V, with a difference of 50 V between V2 and Vb1 or Vb2 as will be apparent also from Table 2, so that the first and second latent images are developed to the same high density with a potential difference of 200 V relative to the bias voltages Vb1 and Vb2, respectively. In the copy mode II shown in FIG. 14*b*, V1 is 450 V, V2 is 200 V and V3 is 50 V, so that the first latent image is developed with a potential difference of 200 V relative to Vb1 which is 250 V, and the second latent image with a potential difference of 150 V relative to Vb2 which is 150 V, eventually giving a dichromatic composite copy image in dark red and light black with a density difference. The copy mode III shown in FIG. 14*c* gives a composite copy image in light red and dark black, and the copy mode IV shown in FIG. 14*d* affords a composite copy image in two light colors. All the voltage sources listed in Table 2, although variable, need not be so adapated; for example, V1 from 2*e* and V2 from 5*e* may be constant at all times, with the bias voltages Vb1 and Vb2 from 16*b* and 17*b* made variable.

EXPERIMENTAL EXAMPLE 1

Composite images were formed under the following conditions by using the copying machine of FIG. 3. A Selenium photoconductive layer of about 30 micron thick vacuum evaporated on an Aluminum drum of 120 mm in diameter was used as the photoconductive drum 1. The drum 1 rotated at a speed of 10 cm/sec was first charged to the initial surface potential V1 of about 600 V by the first scorotron charger 2. This charging was effected by applying to the corona electrode 2*a* a high voltage of 7 KV from the d.c. high voltage source 2*b* while simultaneously applying a bias voltage of 600 V to the grid electrode 2*d* from the d.c. source 2*c*. Subsequently, an image of the positive original was successively exposed to form a first latent image. By this, the potential of the nonimage area was attenuated to VL of about 150 V although it was uneven.

Next, the drum 1 was charged by the second scorotron charger 5 with the high voltage of 6 KV applied to the corona electrode 5*a* while simultaneously applying the voltage Vg of 300 V to the grid electrode 5*d*. By this charging, the potential of VL was corrected to the stable potential V2 of 300 V but the potential of V1 was not affected. The portion of the drum 1 charged to the intermediate potential V2 was then exposed to a negative image to form the second latent image. This exposure attenuated the potential of the image area to 50 V. Thus a composite latent image having three levels of potentials of 600 V, 300 V and 50 V was formed.

The latent image was then developed by the developing roller 7 with a three component developer of magnetic carrier, nonmagnetic red toner and magnetic black toner. For the magnetic carrier, the following compositions were used:

Styrene-acrylic copolymer (HYMER-SBM 75 of Sansei Kasei Co., Ltd.): 100 parts by weight
Magnetic fine powder (MAGNETITE RB-BL of Chitan Industry Co., Ltd.): 200 parts by weight
Carbon black (MA#100 of Mitsubishi Kasei Co., Ltd.): 4 parts by weight
For the nonmagnetic red toner:
Polyester resin (nonlinear saturated polyester): 100 parts by weight
Number-average molecular weight: 12,000
Weight-average molecular weight: 220,000
Glass transition point: 62° C.
Red color pigment (CHROMOPHTAL RED A38 of Ciba Geigy Co.): 5 parts by weight
For the magnetic black toner:
Styrene-acrylic copolymer (HYMER-SBM73): 150 parts by weight
Magnetic fine powder (MAGNETITE RB-BL): 150 parts by weight
Carbon black (MA#100): 6 parts by weight The magnetic carrier had a resistivity of $10^{13}$ Ω·cm and a mean particle size of 35 microns. The nonmagnetic red toner had a resistivity of $10^{15}$ Ω·cm and 11 microns in mean particle size whereas the magnetic black toner had a resistivity of $10^{14}$ Ω·cm and 18 microns in mean particle size. These were thoroughly agitated in a weight ratio of 67:13:20 and as the result, the magnetic carrier and magnetic black toner are triboelectrically charged to positive polarities and nonmagnetic red toner to negative polarity. The bias voltage Vb of 350 V was applied to the developing roller 7 from the voltage source *7a* and by this, the nonmagnetic red toner was deposited on the first electrostatic latent image portion above Vb of 350 V and the magnetic black toner on the second electrostatic latent image portion below the intermediate potential of 300 V.

The developed image was then charged negatively by the precharging corona charger 8, and subsequently it was transferred to the transfer paper and then heat fixed. The image obtained had high density of good quality and was free of fog.

EXPERIMENTAL EXAMPLE 2

Composite images were formed under the following conditions by using the copying machine of FIG. 7. A Selenium photoconductive layer of about 30 micron thick vacuum evaporated on an Aluminum drum of 180 mm in diameter was used as the photoconductive drum 1. In the first step, the drum rotated at a speed of 10 cm/sec was charged to the initial surface potential V1 of 600 V by the first scorotron charger 2. In the second step, an image of positive original was successively exposed to form a first latent image. The potential of the nonimage area has attenuated to VL of about 150 V. In the third step, the first latent image was developed by the first magnetic brush developing roller 16 while applying the bias voltage Vb1 of 250 V to the roller from the voltage source 16*a*. As the developer, a mixture of a magnetic carrier and a nonmagnetic red toner was used. For the magnetic carrier, one with the following compositions was used:

Styrene-acrylic copolymer (HYMER-SBM73): 100 parts by weight
Magnetic fine powder (MAGNETITE RB-BL): 200 parts by weight
Carbon Black (MA#100) 4 parts by weight
For the nonmagnetic red toner:
Polyester resin (nonlinear saturated polyester): 100 parts by weight
Number-average molecular weight: 12,000
Weight-average molecular weight: 220,000
Glass transition point: 62° C.
Red color pigment (CHROMOPHTAL RED A38): 5 parts by weight The magnetic carrier and the nonmagnetic red toner were thoroughly agitated in a weight ratio of 90:10 thereby triboelectrically charging the carrier to positive and toner to negative. The normal development took place and the red toner was deposited on the first latent image portion above Vb1.

In the fourth step, the photoconductive drum 1 was charged by the second scorotron charger 5 with the high voltage of 6 KV applied to the corona electrode 5*a* while simultaneously applying the voltage of 300 l V to the grid electrode 5*d*. By this charging, the potential of the VL was recharged to the intermediate potential V2 of 200 V but the potential of V1 was not affected. In the fifth step, the portion of the drum 1 charged to the intermediate potential V2 was then exposed to exposed to a negative image to form the second latent image having an image area potential V3 of about 50 V.

In the sixth step, the second latent image was developed by the second magnetic brush developing roller 17 while applying the bias voltage Vb2 of 250 V to the roller from the voltage source 17*a*. As the developer, a mixture of the magnetic carrier described above and a nonmagnetic black toner was used. This nonmagnetic black toner was composed of:

Styrene-acrylic copolymer (PLIORITE AC of Goodyear Co.): 100 parts by weight
Carbon black (MA#100): 8 parts by weight
Charge controlling dye (NYGROSINE of Orient Kagaku Co., Ltd.): 2 parts by weight This toner had a resistivity of $10^{15}$ Ω·cm and a mean particle size of 12 microns. The black toner and the magnetic carrier were thoroughly agitated in a weight ratio of 10:90 thereby triboelectrically charging the toner to positive and the carrier to negative. The toner was deposited on the second latent image portion below Vb2 by the reversal development.

The doveloped image was then charged negatively by the precharging corona charger 8 and subsequently it was transferred to the transfer paper and then heat fixed. The image obtained had high density of good quality and was free of fog.

EXPERIMENTAL EXAMPLE 3

Composite images were formed using the copying machine shown in FIG. 10. The conditions are identical to those described in Experimental Example 3 except that the order of the third and the fourth steps was reversed. The bias voltage Vb1 applied was set to 350 V. A composite image of good quality free from fog was obtained.

Numeraous modifications and variations of the present invention are possible in light of the above teachings and, therefore, within the scope of the appended claims, the invention may be practiced otherwise than particulary described.

What is claimed is:

1. A method of forming composite images comprising a step of forming a first electrostatic latent image by exposing a uniformly charged photosensitive surface to an image for producing a first part of the image having a first potential corresponding to an image area and leaving a non-image area at a second unstable potential, a step of charging by a scorotron charger to correct only the second potential to a higher stable potential between the first and second potentials without altering said first potential, and a step of forming a second electrostatic latent image by exposing the higher potential nonimage area to another part of said composite image.

2. A method of forming composite images comprising:

a first step of charging a photosensitive member to a predetermined surface potential of a specific polarity;

a second step of exposing the photosensitive member to a positive image for forming a first electrostatic latent image;

a third step of charging the photosensitive member by a scorotron charger for making the potential of only background area of the first electrostatic latent image higher and uniform without altering the potential of the first electrostatic latent image;

a fourth step of exposing a negative image to the background area charged in the third step to form a second electrostatic latent image;

a fifth step of developing the first and second electrostatic latent images; and a sixth step of transferring the developed image onto a transfer paper.

3. A method as claimed in claim 2 wherein said scorotron charger includes a d.c. voltage source connected to a grid electrode and a voltage applied to the grid electrode from the d.c. voltage source is lower than the surface potential of said first step but higher than the potential of background area of the first electrostatic latent image formed in said second step.

4. A method as claimed in claim 3 wherein said fifth step is effected by a magnetic brush development while applying to a developing electrode a bias voltage substantially equal to or close to the background potential charged in the third step.

5. A method of forming composite images comprising;

a first step of charging a photosensitive member to a surface potential of V1;

a second step of exposing a positive image thereby forming a first electrostatic latent image having potentials of VL corresponding to a background area and of about said V1 corresponding to an image area;

a third step of charging the photosensitive member by a scorotron charger to correct only said potential of VL to a higher potential of V2 intermediate V1 and VL without effecting the potential of V1, said scorotron charger including a corona electrode connected to a high voltage source and a grid electrode connected to a d.c. voltage source wherein a voltage applied to the grid electrode is higher than said VL but lower than said V1;

a fourth step of exposing a negative image to the portion of said intermediate potential of V2 thereby forming a second electrostatic latent image having an image area potential of V3 relative to said V2;

a fifth step of developing said first and second electrostatic latent images by a magnetic brush development wherein a bias voltage substantially equal to or close to the intermediate potential of V2 is applied to a developing electrode and a toner of first polarity is deposited on the image area of the first electrostatic latent image and a toner of second polarity is deposited on the image area of the second electrostatic latent image; and a sixth step of transferring the developed image onto a transfer paper.

6. A method as claimed in claim 5 wherein said toners are different in color.

7. A method as claimed in claim 5 wherein said first step of charging is effected by the scorotron charger used in said third step but with the voltage applied to the grid electrode set to equal to about V1 and said second and fourth steps of exposing are effected by a single image exposure source.

8. A method of forming composite images comprising:

a first step of charging a photosensitive member to a predetermined surface potential;

a second step of exposing a positive image for forming a first electrostatic latent image;

a third step of developing the first electrostatic latent image with a toner of first polarity while applying a first bias voltage to a developing electrode, said first bias voltage being higher than a potential of background area but lower than a potential of image area of the first electrostatic latent image;

a fourth step of charging the photosensitive member by a scorotron charger to charge only the background area of the first electrostatic latent image to an intermediate potential without affecting the potential of the image area, said intermediate potential being higher than the potential of the background area but lower than the potential of the image area of the first electrostatic latent image formed in said second step;

a fifth step of exposing a negative image to the portion of said intermediate potential for forming a second electrostatic latent image;

a sixth step of developing the second electrostatic latent image with a toner of second polarity while applying a second bias voltage to a developing electrode, said second bias voltage being substantially equal to or little lower than the intermediate potential; and a seventh step of transferring the developed image onto a transfer paper.

9. A method as claimed in claim 8 where in said scorotron charger includes a grid electrode connected to a d.c. voltage source and a voltage applied to the grid electrode substantially equal to the intermediate potential to be charged.

10. A method as claimed in claim 9 wherein said toners of first and second polarities are different in color.

11. A method as claimed in claim 9 wherein said first step of charging is effected by the scorotron charger used in said fourth step but with the voltage applied to the grid electrode substantially equal to the surface potential to be charged and said second and fifth steps of exposing are effected by a single image exposure source.

12. A method of forming composite images comprising:

a first step of charging a photosensitive member to a predetermined surface potential;

a second step of exposing a positive image for forming a first electrostatic latent image;

a third step of charging the photosensitive member by a scorotron charger to charge only the background area of the first electrostatic latent image to an intermediate potential without altering the image area potential of said first electrostatic latent image, said intermediate potential being higher than the potential of the background area but lower than the potential of the image area of the first electrostatic latent image;

a fourth step of developing the first electrostatic latent image with a toner of first polarity while applying a first bias voltage substantially equalling to or somewhat higher than the intermediate potential to a developing electrode;

a fifth step of exposing a negative image to the portion of said photosensitive member which is at said intermediate potential for forming a second electrostatic latent image;

a sixth step of developing the second electrostatic latent image with a toner of second polarity while applying a second bias voltage to a developing electrode, said second bias voltage being substantially equal to or little lower than the intermediate potential; and a seventh step of transferring the developed image onto a transfer paper.

13. A method as claimed in claim 12 wherein said scorotron charger includes a grid electrode connected to a d.c. voltage source and a voltage applied to the grid electrode substantially equal to the intermediate potential to be charged.

14. A method as claimed in claim 13 wherein said toners of first and second polarities are different in color.

15. A method as claimed in claim 13 wherein said first step of charging is effected by the scorotron charger used in said third step but with the voltage applied to the grid electrode substantially equal to the surface potential to be charged and said second and fifth steps of exposing are effected by a single image exposure source.

16. A method of forming composite image comprising:

a first step of charging a photosensitive member to a surface potential of certain value;

a second step of exposing said member to a positive image for forming a first electrostatic latent image;

a third step of charging the photosensitive member by a scorotron charger to charge only the background area of the first electrostatic latent image to an intermediate potential without altering the image area potential, said intermediate potential being higher than the potential of the background area but lower than the potential of the image area of the first electrostatic latent image;

a fourth step of developing the first electrostatic latent image with a toner of first polarity while applying a first bias voltage to a developing electrode, said first bias voltage being variable to control the density of the first latent image developed;

a fifth step of exposing the portion of said member which is at said intermediate potential to a negative image for forming a second electrostatic latent image;

a sixth step of developing the second electrostatic latent image with a toner of second polarity while applying a second bias voltage to a developing electrode, said second bias voltage being variable to control the density of the second latent image developed; and a seventh step of transferring the developed image onto a transfer paper.

17. A method as claimed in claim 16 wherein the surface potential in said first step and the intermediate potential in said third step are also variable.

* * * * *